United States Patent [19]

Pollert et al.

[11] Patent Number: 4,743,342

[45] Date of Patent: May 10, 1988

[54] COKE QUENCHING APPARATUS

[75] Inventors: Georg Pollert, Essen; Friedrich Orywal, Heiligenhaus; Claus Meyer-Wulf, Bochum; Martin Reinke, Dortmund, all of Fed. Rep. of Germany

[73] Assignee: Bergwerksverband GmbH, Essen, Fed. Rep. of Germany

[21] Appl. No.: 939,163

[22] PCT Filed: Mar. 15, 1986

[86] PCT No.: PCT/EP86/00147

§ 371 Date: Dec. 17, 1986

§ 102(e) Date: Dec. 17, 1986

[87] PCT Pub. No.: WO86/05507

PCT Pub. Date: Sep. 25, 1986

[30] Foreign Application Priority Data

Mar. 23, 1985 [DE] Fed. Rep. of Germany ..... 3510678

[51] Int. Cl.[4] ..... C10B 39/14

[52] U.S. Cl. ..... 202/227; 202/230

[58] Field of Search ..... 201/39; 202/227, 230, 202/263; 105/254

[56] References Cited

U.S. PATENT DOCUMENTS

| | | | |
|---|---|---|---|
| 4,010,695 | 3/1977 | Mantione | 105/254 |
| 4,213,489 | 7/1980 | Cain | 201/39 |
| 4,285,772 | 8/1981 | Kress | 201/39 |
| 4,312,711 | 1/1982 | Brown et al. | 202/227 |
| 4,396,461 | 8/1983 | Neubaum et al. | 201/39 |

FOREIGN PATENT DOCUMENTS

| | | |
|---|---|---|
| 372996 | 4/1923 | Fed. Rep. of Germany . |
| 601392 | 8/1934 | Fed. Rep. of Germany . |
| 1253669 | 11/1967 | Fed. Rep. of Germany . |
| 2435500 | 2/1976 | Fed. Rep. of Germany . |
| 2533606 | 4/1976 | Fed. Rep. of Germany . |
| 363366 | 12/1931 | United Kingdom . |

*Primary Examiner*—Barry S. Richman
*Assistant Examiner*—Joye L. Woodard
*Attorney, Agent, or Firm*—Karl F. Ross; Herbert Dubno

[57] ABSTRACT

A coke quenching car comprises an open coke receptacle having a sloping bottom wall inclined toward one side, closely spaced vertical internal walls, a vertical side wall opposite the one side and end walls. All of the walls are formed with cooling fluid passages. The vertical side wall includes a coke discharge opening closed by a swingable L-shaped flap having a leg portion with a cooling fluid passage and a foot portion underhanging the bottom wall in a closed position. The foot portion is provided with aperatures for draining quench water from the receptacle when the flap is swung into a drain position. A fluid cooled slidable cover for the receptacle is provided.

1 Claim, 4 Drawing Sheets

COKE QUENCHING APPARATUS

CROSS REFERENCE TO RELATED APPLICATIONS

This application is a national phase application corresponding to PCT/EP86/00147 filed 15 Mar. 1986 and based, in turn, on a German national application No. P35 10 678.6 filed 23 Mar. 1985 under the International Convention

FIELD OF THE INVENTION

The present invention relates to a method of quenching coke and to an apparatus needed to carry out this method.

BACKGROUND OF THE INVENTION

Up to now two basically different methods of quenching incandescent coke have been used, i.e. the so-called wet quenching and the so-called dry quenching methods.

In the dry quenching method, of which several different alternatives were disclosed in Glückauf 114 (1978), on pages 611/619, the sensible heat of the coke is abstracted either by direct or indirect heat exchange and mostly recovered. The coke is discharged from the plant at temperatures comprised between 150° C. and 250° C.

The direct heat exchange is provided by circulated gas whose heat energy is recovered by the heat exchange cycle.

An exclusively indirect cooling requires long residence times so that to ensure sufficient cooling capacity large heat exchange volumes are necessary.

Capital and operational costs of coke dry quenching plants are comparatively high.

While sizeable gaseous emissions do not develop with these systems, they involve serious practical drawbacks which require solution and relate to the development of large dust volumes during handling of the dry-quenched coke.

With wet quenching of coke according to the present state of the art the coke is cooled by evaporation of the sprayed water. Caused by thermal buoyancy, particulate emissions are produced during this treatment which may with modern quenching towers attain an order of magnitude of 50 g/t of coke. Besides there are gaseous emissions, e.g. in the form of hydrogen sulphide and carbon monoxide, as products of chemical reactions between the hot coke and water. Such reactions, if they occur at temperatures above 800° C., lead to conspicuous pollutant emissions.

OBJECT OF THE INVENTION

The object of the present invention is to provide an apparatus which will avoid these drawbacks of the known coke quenching methods.

SUMMARY OF THE INVENTION

These drawbacks are effectively avoided, indeed, by coke quenching.

In a first step, cooling the coke to below approx. 900° C., possibly to between 700 and 900° C., by means of an indirect heat exchanger, and then quenching the coke to ambient temperature in a second step involving the spraying of water. During the first step steam or hot water is produced. The apparatus used can comprise a mobile coke receptacle equipped with cooling faces for indirect heat exchange as well as with closing separate discharge openings for water and coke. The cooling surfaces are formed to function as indirect water coolers or as steam-generate units. The coke receptacle can be equipped with a lid.

The dust evaluation typical for a conventional dry quenching installation is not encountered with the method as per the invention as the coke which had been pre-cooled during the first process step, is wetted uniformly during the second step so that any dust development during coke handling is subdued. At the same time the coke temperature is brought down, prior to wet quenching, far enough as to essentially subdue any reactions taking place at an accelerated pace if higher temperatures prevailed. Thermal buoyancy of the wet quenching phase is mitigated as well so that there is also a noticeable reduction of particulate emission.

Cost expenditure is lower as compared to coke dry quenching. As with the latter, part of the sensible coke heat may be recovered though so that its reuse will likewise contribute to the economics of the method.

BRIEF DESCRIPTION OF THE DRAWING

A more detailed illustration of the procedure is given by way of the following examples. In the drawing.

SPECIFIC DESCRIPTION

Figure 1:
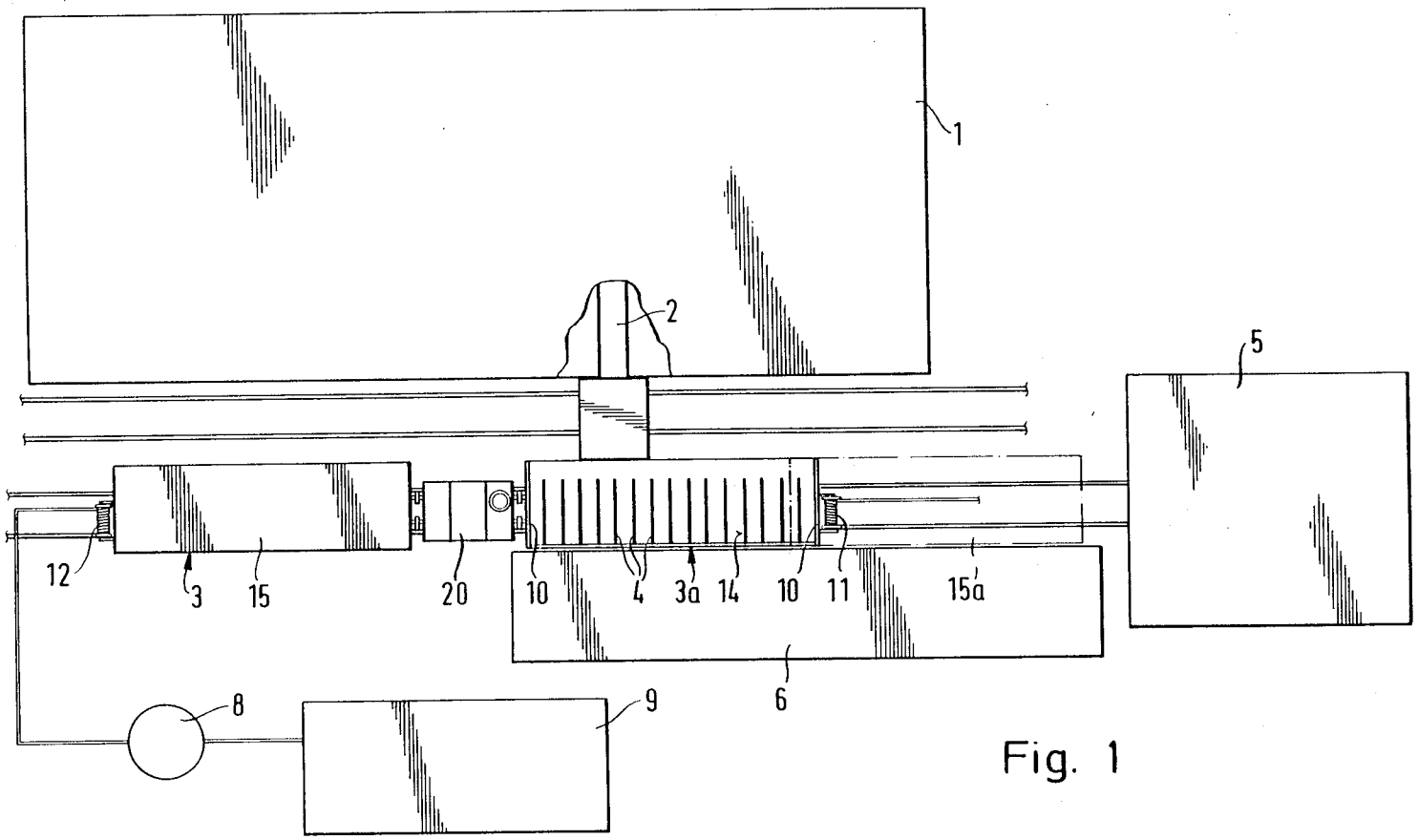
FIG. 1 is a process flowsheet.
Figure 2:
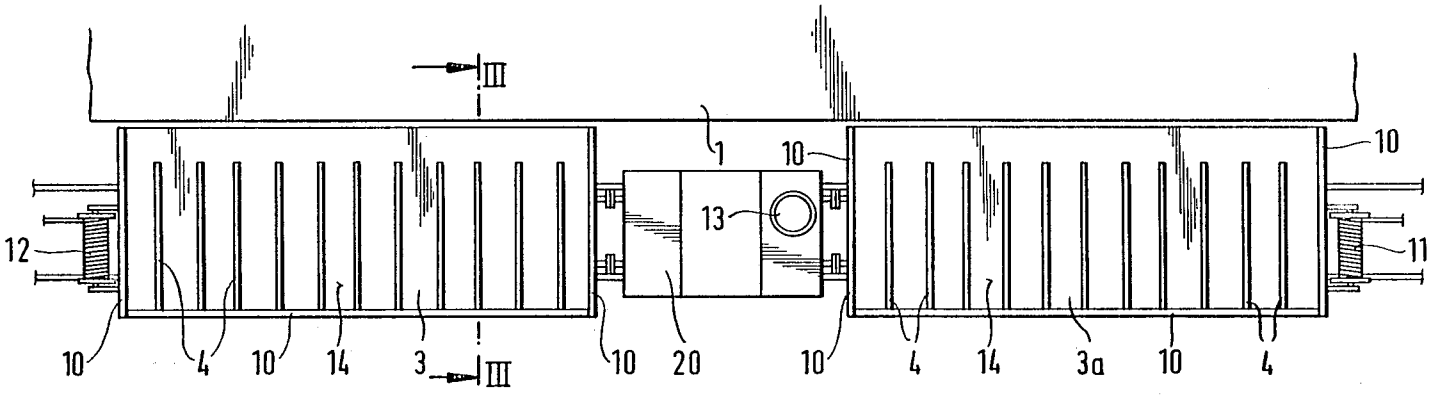
FIG. 2 is a plan view of an embodiment of the coke receptacle, seen from above.
Figure 3:
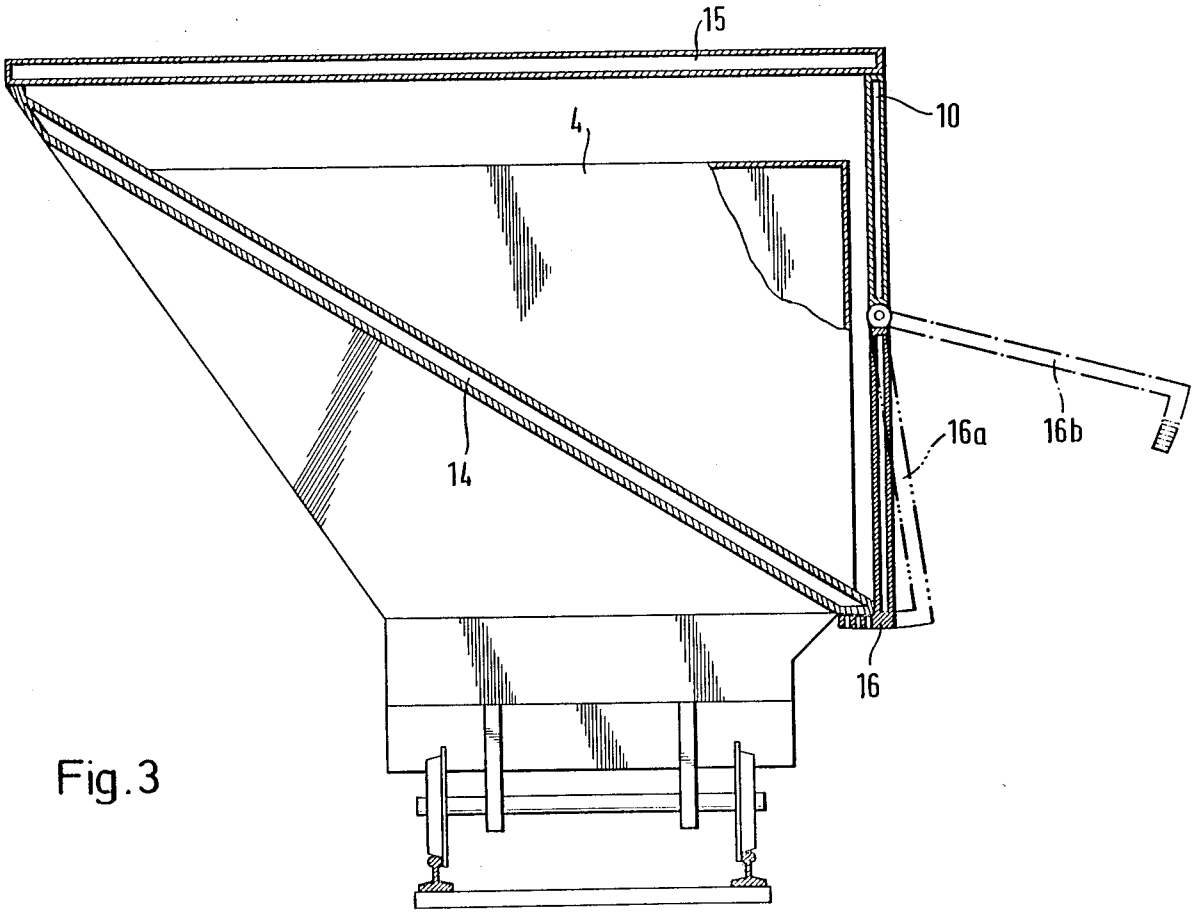
FIG. 3 is a cross-sectional view of the receptacle depicted in FIG. 2.

In the embodiment illustrated in FIGS. 1 through 3 the coke is, upon completion of the coke cycle and at a temperature of e.g. 1100° C., pushed from the coke oven (2) into one of the two coke recipients (3, 3*a*). During this the recipients (3, 3*a*) are moved into a parallel position in respect to the battery (1) in order to ensure an as even as possible distribution of the bulk of coke discharged from the oven (2) throughout the surface of the recipient (3). A lid (15, 15*a*) is provided to gradually slide over the top of the recipient to close the same.

In the embodiment of FIG. 3 the sloping bottom of the coke recipient (3) is equipped with cooling walls (4) arranged vertically to the axis of the battery (1), at e.g. 40 cm spacing. The cooling walls (4), bottom surface (14), outer walls (10) (FIG. 2) and lid (15) (FIG. 3) of the coke recipient (3) are, in the present example, formed as hollow bodies functioning as generating units.

The cooling water is fed to the coke recipient (3) e.g. through a permanently connected, unrollable, flexible hose (11). The steam generated (at e.g. 5 bar) is supplied via a likewise permanently connected flexible hose (12) to a compensation tank (8) and thence e.g. to the by-product plant (9).

The coke remains in recipient (3) until another similar recipient (3*a*), powered by the same drive (20), has been filled with coke and closed by the lid (15*a*) described earilier.

During the residence of the coke in recipient (3 or. 3*a*) in front of the battery (1) e.g. 10 minutes the coke temperature is brought down to e.g. 800° C., while about 130 kg steam/ton of coke are generated. Then, while the recipient (3) advances to underneath the quenching tower (5), the lid (15) is removed and the coke sprayed with water so that it cools down to ambient temperature. During this the water-sprayed coke is discharge (16) is moved to a position (16*a*) where the indicated water discharge orifices are unblocked.

Unloading of the coke onto the coke ramp (6) is done in the conventional way, with the water- and coke discharge flap (16) being moved to a discharge position (16*b*).

One variation of the embodiment shown on FIGS. 1 through 3 is that the uncontaminated steam raised pursuant to FIG. 2 is not used but, instead, released at atmospheric pressure through a stack (13) into the air.

Figure 4:
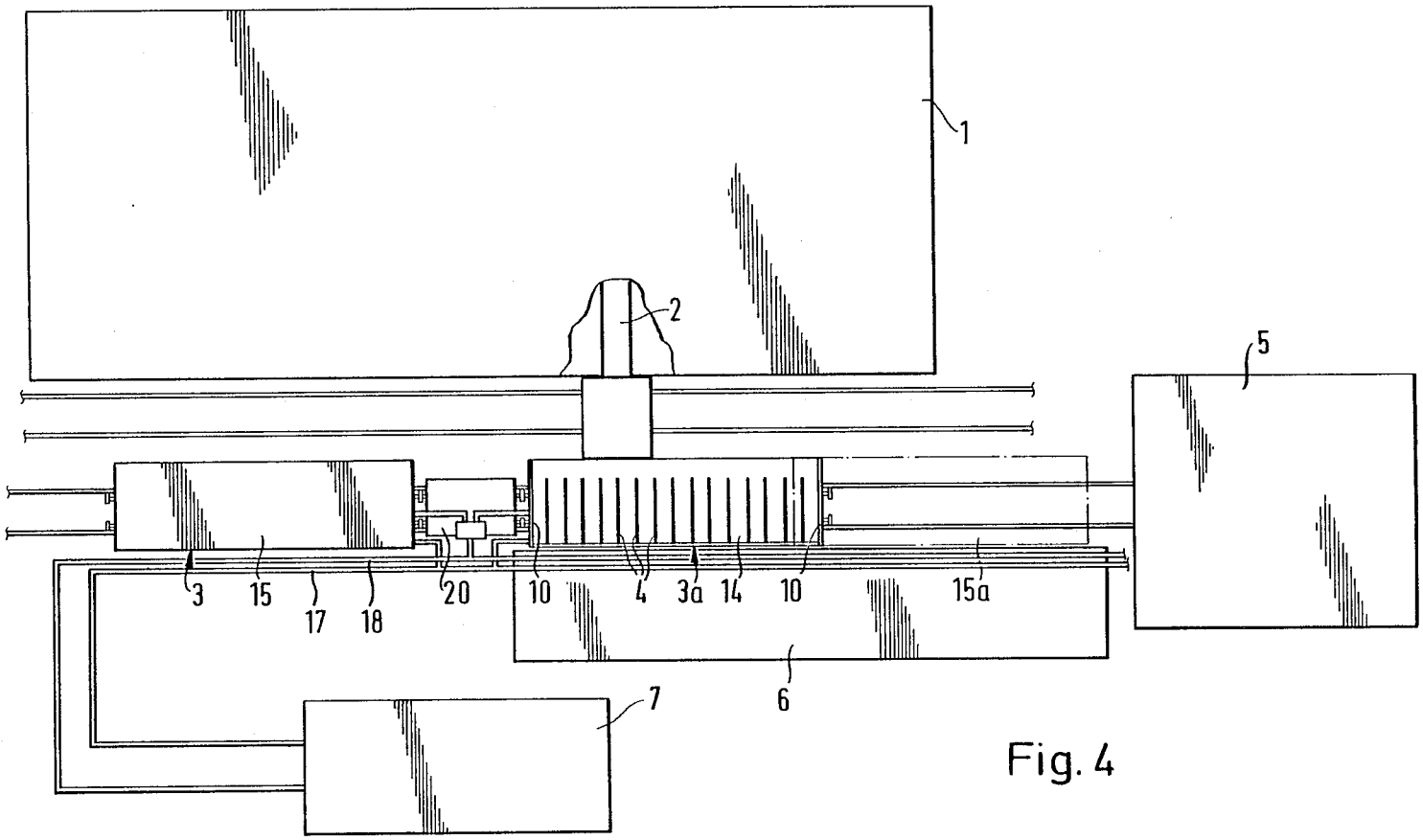
FIG. 4 is a variation of the flowsheet of FIG. 1.

With the variation as represented in FIG. 4, the cooling walls (4), outer walls (10), bottom surface (14) and lid (15) are configured to function as water coolers.

The cooling water is supplied from the cooling water channel (17) via a pump (not shown). The spent cooling water discharged from the system is fed through channel (18) to the cooling tower (7).

Another possible embodiment, for steam generation, has a supply water tank mounted on a drive unit (20) moved along with the system and topped-up at given intervals.

What is claimed is:

1. An apparatus for the quenching of coke which comprises an upwardly open coke receptacle having a sloping bottom wall inclined toward one side of said receptacle, closely spaced vertical internal walls, a vertical side wall opposite said one side and end walls, each of said walls being provided with passages for a cooling fluid, said vertical side wall of said receptacle including an opening for discharging quenched coke;

an L-shaped flap swingably mounted on said vertical side wall of said receptacle and having a leg portion provided with a passage for a cooling fluid and a foot portion underhanging said bottom wall in a closed position of said flap, said foot portion being provided with apertures for the discharge of quench water from said receptacle upon a partial displacement of said flap out of said closed position thereof to a drain position wherein said opening remains closed to drain quench water from coke in said receptacle through said apertures, said flap being swingable upwardly from said drain position in which quench water is drained to discharge coke from said receptacle;

a cover slidable over said receptacle for covering same and formed with cooling passages for a cooling fluid; and inlet means for supplying said passages with cooling fluid.

* * * * *